US009386838B1

(12) United States Patent
Smith

(10) Patent No.: US 9,386,838 B1
(45) Date of Patent: Jul. 12, 2016

(54) LIP BALM TUBE HOLDERS

(71) Applicant: Kevin Smith, Rocky Mount, VA (US)

(72) Inventor: Kevin Smith, Rocky Mount, VA (US)

(73) Assignee: Liplox Limited Company, Daleville, VA (US)

( * ) Notice: Subject to any disclaimer, the term of this patent is extended or adjusted under 35 U.S.C. 154(b) by 464 days.

(21) Appl. No.: 13/745,536

(22) Filed: Jan. 18, 2013

Related U.S. Application Data

(60) Provisional application No. 61/588,281, filed on Jan. 19, 2012.

(51) Int. Cl.
*A45D 40/00* (2006.01)

(52) U.S. Cl.
CPC ..... *A45D 40/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,816,548 | A * | 10/1998 | Blossom, III | 248/206.5 |
| 6,530,510 | B2 * | 3/2003 | Ferrari | 224/547 |
| 6,871,767 | B2 * | 3/2005 | Perlman et al. | 224/269 |
| 7,195,413 | B2 * | 3/2007 | Kremizis | 401/131 |
| 7,270,289 | B2 * | 9/2007 | Kish | 242/280 |
| 8,414,209 | B2 * | 4/2013 | Forrey | 401/52 |

* cited by examiner

*Primary Examiner* — David Walczak
(74) *Attorney, Agent, or Firm* — Rhodes IP PLC; Christopher R Rhodes

(57) ABSTRACT

A lip balm tube holder can be constructed and arranged to retain a lip balm tube, e.g., constructed and arranged to retain a lip balm tube vertically. In some embodiments, the lip balm tube holder can include a body comprising an opening sized and arranged to releasably receive a lip balm tube.

16 Claims, 10 Drawing Sheets

LIP BALM TUBE HOLDERS

PRIORITY APPLICATION

This application claims priority to U.S. Provisional Application No. 61/588,281 filed on Jan. 19, 2012, the entire disclosure of which is hereby incorporated herein by reference for all purposes.

TECHNOLOGICAL FIELD

This application is related to devices for securely holding lip balm tubes, e.g., lip balm tube holders configured to hold the lip balm vertically. In certain embodiments, an article configured to releasably receive a container of lip balm is provided.

BACKGROUND

Lip balm is commonly used to reduce dry or chapped lips which may occur during winter months or at other times of the year. Users frequently misplace their lip balm which forces them to purchase additional lip balm. This process is frequently repeated and favors non-desirable application frequency of the lip balm.

SUMMARY

In a first aspect, a lip balm tube holder is provided. In certain embodiments, the lip balm tube holder comprises a body comprising an opening sized and arranged to releasably receive a lip balm tube, e.g., receive a lip balm tube and retain the lip balm tube through a friction fit or some other fit that can engage the lip balm tube in an effective manner to retain the lip balm tube in the holder. In other embodiments, the holder can comprise attachment means coupled to the body, the attachment means configured to retain the lip balm tube holder vertically when exposed to a force.

In certain examples, the attachment means can include magnet means. In other embodiments, the body of the lip balm tube holder can be configured as a tapered body with the diameter of the body at the mouth of the opening larger than a diameter of the body at the base. In some examples, the body of the lip balm tube holder can be configured with a desired shape, e.g., a shotgun shell shape, a baseball bat shape, a football shape, a bottle, etc. In certain examples, the lip balm tube holder may also comprise at least one logo or other indicia on an outer surface of the lip balm tube holder.

In another aspect, a lip balm tube holder comprising a body comprising an opening sized and arranged to releasably receive a lip balm tube and retain the lip balm tube in the holder, e.g., through a friction fit, and attachment means coupled to the body, the attachment means configured to keep the lip balm tube holder stationary on a horizontal surface is described.

In certain embodiments, the attachment means can include magnet means positioned on a longitudinal surface of the body. In other embodiments, the body can be configured as a tapered body with the diameter of the body at the mouth of the opening larger than a diameter of the body at the base. In additional embodiments, the body can be configured with a desirable shape, a shotgun shell shape, a baseball bat shape, a football shape, etc.

In an additional aspect, a method of facilitating retention of a lip balm tube comprising providing one or more of the lip balm tube holders described herein is provided.

In an another aspect kit comprising one or more of the lip balm tube holders as described herein and instructions for using the lip balm tube holder with a lip balm tube are provided.

In an additional aspect, a lip balm tube holder comprising a housing sized and arranged to couple to an electrical accessory outlet of a vehicle, the housing further sized and arranged to receive a lip balm tube and retain the lip balm tube through a friction fit is provided. In some embodiments, the holder can also include coupling means coupled to the housing and configured to contact an electrical conductor of the electrical accessory outlet of the vehicle.

In certain embodiments, the housing comprises a cooling element. In other embodiments, the housing comprises a thermostat. In certain examples, the housing comprises a heating element. In some examples, the housing comprises a first portion that is coupled to the electrical accessory outlet and a second portion that protrudes from the electrical accessory outlet. In additional examples, the second portion is configured to comprise a shotgun shell shape. In some examples, the second portion is configured to comprise a baseball bat shape. In additional examples, the second portion comprises at least one logo or other indicia. In certain examples, the coupling means is removable from the housing. In some embodiments, the removable coupling means comprises a conductive disk. In further embodiments, the housing further comprises an external electrical coupler that is accessible when the lip balm tube is inserted into the lip balm tube holder. In certain embodiments, the housing further comprises an external electrical coupler that is inaccessible when the lip balm tube is inserted into the lip balm tube holder. In some instances, the electrical coupler is configured as a microUSB coupler, a 10-pin connector, a 30-pin connector or a USB connector. In other configurations, the housing can include a light source, e.g., a light emitting diode or other suitable light sources. In some instances, the conducting means is positioned in a second portion of the housing that can reversibly couple to a first portion of the housing.

In other aspects, the holders described herein can be used with a common lip balm tube. In some embodiments, this tube contains lip balm in a solid state that can be advanced by a wheel mechanism and be applied to the lips once the cap is removed. Certain embodiments of the lip balm tube holder can be formed from many different materials and using many different processes, e.g., using an injection molded plastic. In some examples, the holder can be made with a cylindrical cavity. In certain configurations, the opening at the top of the cavity can be designed to receive the bottom end of the lip balm tube. If desired, the opposite end of the cavity can be closed where the base of the tube rests. In certain examples, the holder is configured to sit upright comprising a recess within the exterior of its base where a magnet can be attached with an adhesive, weld, or other method. In some configurations, there may be a recess along the long axis of the holder where another magnet, for example, can be attached by one of these methods. In embodiments including these magnets, the holder can be placed on a surface that is magnetic or paramagnetic including, but not limited to, a desk, table, dry erase board, dashboard, transmission shifters, accessory plugs, a refrigerator or other articles including magnetic components. In one configuration, an accompanying component of the holder is a small, thin steel disk with adhesive and liner on one side. Removing the liner, the disk can be placed on a variety of non-ferrous surfaces allowing the holder to be attracted to the disk. In some embodiments, an additional recess in the base of the holder can be made approximately the same thickness of this disk with a slightly greater width or diameter if desired. The base, attracted by magnetic force, then fits over the disk aiding in the horizontal stability of holder.

In certain embodiments, the holder can be configured with a space for the user to grip the lip balm tube with two fingers at the top of the tube, below the cap. The diameter at the opening of the cavity can be greater than at any other point along the cavity, allowing the tube easier entry into the holder. Inside the base of the recess, the diameter can decrease slightly conforming to the tube's dimensions and to grip the lip balm's base by friction. This illustrative configuration allows the holder to be moved and turned upside down with less chance of the tube releasing from the holder. The friction still allows the user to retrieve the lip balm with little force and less pull than the magnet exerts at its base or along its length. In some configurations, the holder can be created with a texture which allows the tube to be gripped more securely at its base.

In some instances, the holder can be produced to contain a single lip balm tube could or can be configured to hold two or more lip balm tubes with multiple openings to hold the tubes upright.

Additional aspects, embodiments, attributes and features are more particularly described below.

BRIEF DESCRIPTION OF THE FIGURES

Certain illustrative embodiments are described in more detail below with reference to the accompanying figures in which.

Figure 1:
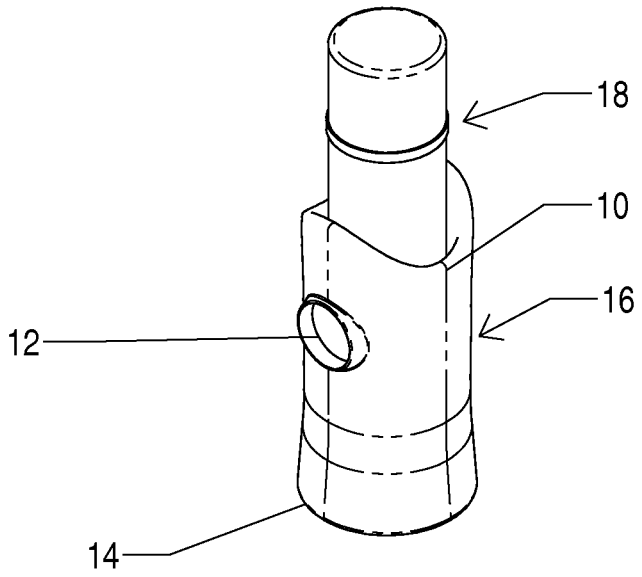
FIG. 1 is a perspective view of an embodiment of a lip balm tube, in accordance with certain embodiments.

It will be recognized by the person of ordinary skill in the art, given the benefit of this disclosure, that the dimensions, relative sizes, relative proportions and the like shown in the figures are provided for illustration purposes and are not intended to be limiting. Where one or more different views are shown, the views can be considered separately such that the lip balm holder many include one or more than one of the particular configurations represented by any one figure or combination of the figures.

DETAILED DESCRIPTION

Certain embodiments described herein are directed to holders or carriers for lip balm tubes. More particularly, certain examples describe a holder for a lip balm tube that is configured to keep the lip balm in tube in one or more configurations including, but not limited to, vertical, stationary, accessible, mobile and/or decorative. By using a lip balm holder as described herein, the user can benefit from a safer experience using the lip balm while driving, for example, and can in general receive a more enjoyable experience using lip balm in a tube. In some instances, the lip balm tube holder may be configured to couple to an electrical accessory outlet of the vehicle and may include one or more electrical couplers to permit use of the accessory outlet through the lip balm tube holder.

In certain examples, a holder for a lip balm tube can be configured to receive a tube of lip balm and provides additional features for the user of the lip balm in a tube. For example, these features can include keeping the lip balm tube upright, stationary, accessible, transportable and decorative. The most common lip balm tube has an approximate diameter to height ratio of 1 to 4, making the lip balm unsteady when subjected to any movement. This instability is amplified as the lip balm is used and advanced upward in the tube by the tubes' wheel mechanism, making the lip balm tube top-heavy. For this reason, a lip balm tube is often found lying horizontally or has a tendency to become horizontal under normal use conditions. Keeping the lip balm tube upright or vertical is important because the lip balm within the tube melts when subjected to higher temperatures, such as in a car on a summer day. When the lip balm melts within the tube in the horizontal position, it melts into the cap and sometimes escapes the tube itself in liquid form. The melted lip balm is often an unusable and a mess for its owner including potential damage to the vehicle interior.

In certain embodiments, by keeping the lip balm stationary and accessible, it is meant that the lip balm tube can be found by the user when needed. Since the common lip balm tube is cylindrical and unstable and often lies horizontally, it can roll off a desk, under a car seat, or otherwise out of sight of the user. In addition, placement of lip balm tube in a pocket often results in sliding of the lip balm tube out of the pocket when a user sits in a seat such as a vehicle seat. In some cases the user may feel the need to apply lip balm while driving and is distracted while looking for the lip balm tube while in this situation. If the lip balm tube is not found, the user may purchase another and find the original tube months later, under the car seat in an often undesirable or unusable state.

In certain examples, the lip balm holder can include one or more aesthetic features including decorative features which may be permanent or may be applied by an end user. For example, team or company logos, patterns or printing that communicate to the user of the holder may be included on the lip balm holder.

Certain embodiments herein refer to the lip balm tube as being transportable. By keeping the lip balm tube transportable it is meant that the lip balm tube can be moved from place to place within the holder and be retained within the holder even when turned upside down. This way the other features can be retained, as an example, in a vehicle and then once transported to an office cubicle.

Certain attributes are provided by embodiments of the lip balm holder described herein. These include, but are not limited to, proper sizing and arrangement of the holder to securely, but releasably, retain the lip balm tube, permitting of the holder to remain stable and vertical on many different types of horizontal surfaces subject to movement, e.g., surfaces in car, boat or other vehicle, and placement of the lip balm tube vertically along a vertical plane, e.g., where the long axis of the lip balm tube is parallel to a vertical surface such as a wall or refrigerator. In some instances, the lip balm tube engages interior surfaces of the lip balm tube holder through a friction fit. If desired, the lip balm tube holder may include interior surfaces that are slick or low friction to permit easy insertion and removal of the lip balm tube from the lip balm tube holder. In some instances, the interior surfaces can be coated with a low friction material, e.g., polytetrafluoroethylene or other suitable materials, to enhance insertion and removal of the lip balm tube from the holder.

In certain embodiments, the lip balm holder can be constructed and arranged to maintain the lip balm vertically on a variety of surfaces, which can reduce potential mess and extend the life of the lip balm. In other configurations, the lip balm holder may be adapted to keep the lip balm tube stationary so that the cylindrical lip balm tube will not roll or fall off of a horizontal surface. In further configurations, the lip balm tube holder can be configured to keep the lip balm tube accessible so that it can be found when needed by the user. In additional configurations, the lip balm tube holder can be configured with one or more decorative features. In certain instances, the lip balm tube holder can be configured to permit "drop in" fitting of the lip balm tube without substantial resistance from the holder. In some configurations, the holder may be configured for portability, e.g., can be moved from place to place while retaining the tube even if jostling, turning upside down or substantial movement is present. In some embodiments, the housing or body of the lip balm tube holder can be configured with multiple pieces or components that can mate or couple to each other in a desired configuration. For example, a single base can be used and coupled to different bodies to provide for different aesthetic shapes for holding the lip balm tube. In some instances, the different components can couple to each other to provide a desired angle or joint between the two different components, e.g., to position the lip balm tube at a desired angle. In other configurations, the different components can couple to each other through suitable threads or lock-pin configurations to retain one portion of the holder to the other portion of the holder. Additional configurations and features thereof are described in more detail below.

In certain examples, one embodiment of a lip balm tube holder is shown in FIG. 1. For reference purposes, a lip balm tube holder 16 is shown with an inserted lip balm tube 18. Tube 18 is usually a tube with a wheel mechanism at its base and a cap at its top. In certain configurations, the holder 16 can comprise one or more concave dips, such as concave dip 10, to provide for greater accessibility. While FIG. 1 shows a holder 16 with a concave dip 10, if desired, the length along the longitudinal axis may be substantially constant such that no concave dip is present. In certain configurations, the holder 16 may include a substantially constant radius along its longitudinal axis, whereas in other configurations, the radius at the upper portion of the holder 16, e.g., the portion closest to where the bottom of the lip balm tube 18 is first inserted, may be larger than the radius at the lower portion 124 of the holder 16, e.g., at the base 14 of the holder 16. By selecting proper radii sizes for different portions of the holder 16, increased frictional resistance may result as the lip balm tube 18 is inserted further into the holder 16. In operation, the tube holder 16 can receive the bottom of the tube 18 exposing enough of the tube 18 to be gripped by the user on at least one end. The user may firmly grasp the lip balm tube 18 and the lip balm holder 16 and remove the tube 18 by disengaging it from the holder 16. In some embodiments where the lip balm tube holder 16 is configured to release the lip balm tube 18, the lip balm tube 18 can be removed from the holder 16 when the lip balm supply is exhausted, and the holder 16 may be reused with a new lip balm tube. In other instances, the lip balm tube 18 may be inserted positively and securely into the lip balm tube holder 16 such that the lip balm tube 18 may not be removed from the holder 16 after insertion. Once the lip balm supply is exhausted the combination of the lip balm tube 18 and holder 16 would be discarded. If desired an adhesive can be included on internal surfaces of the holder 16 such that insertion of the tube 18 into the holder 16 results in permanent adherence of the tube 18 to the holder 16.

In certain embodiments, the holder 16 may include a recess, groove or depression 12 in its surface such that an attachment means can be inserted and used to assist in retaining the holder 18 in a desired location or at a desired angle, position, etc. In some examples, the recess 12 may receive a magnetic attachment means as described below in reference to FIG. 11. In other configurations, the attachment means may take the form of a releasable adhesive, hook and loop fastener, double-sided tape or other suitable attachment means such as, for example, clipping onto a sun visor, clipping into or positioning with a notebook or placement inside a pocket book, purse, backpack or other suitable articles.

In certain examples, the holder 16 can be produced using many different types of materials including, but not limited to, a plastic, a ceramic, a leather, an elastomeric material, wood, paper, a metal, a metal alloy, a ceramic, a composite material and combinations thereof. In some embodiments, the material can be selected such that is may be molded, stamped or otherwise formed into desired shapes and/or dimensions. For example, the material can be selected such that it may be injection molded into a desired configuration. In other embodiments, the material can be selected to include a material with a low thermal transfer coefficient such that the temperature of the lip balm tube holder remains substantially constant and resists heating and cooling. For example, the material can be selected such that placement of a lip balm tube from a user's pocket into the holder acts to maintain the temperature of the lip balm tube holder at a temperature similar to that which was present in the user's pocket. Suitable materials with low thermal transfer coefficients include porous materials such as, for example, porous plastics, porous foams and other materials that can function as insulators.

In certain embodiments, the body or housing of the holder 16 may include one or more thermoplastic materials or thermoset materials. Illustrative thermoplastic materials include, but are not limited to, acrylonitrile butadiene styrene, acrylic, cellulose acetate, cyclic olefin copolymer, ethylene vinyl acetate, ethylene vinyl alcohol, a fluoroplastic, an ionomer, a polyoxymethylene, a polyacrylate, a polyacrylonitrile, a polyamide, a polyamide-imide, a polyaryletherketone, a polybutadiene, a polybutylene, a terephthalate, a polybutylene terephthalate, a polycarbonate, a polyhydroxyalkonoate, a polyketone, a polyester, a polyethylene, a polyetheretherketone, a polyetherketoneketone, a polyetherimide, a polyethersulfone, a chlorinated polyethylene, a polyimide, a polylactic acid, a polymethylpentene, a polyphenylene oxide, a polyphenylene sulfide, a polyphthalamide, a polypropylene, a polystyrene, a polysulfone, a polytrimethylene terephthalate, a polyurethane, a polyvinyl acetate, a polyvinyl chloride, a polyvinylidene chloride, a styrene-acrylonitrile and combinations and copolymers thereof. Illustrative thermosets include, but are not limited to, a polyurethane, a foam, a polyester, an elastomer such as natural rubber, vulcanized rubber or the like, a melamine resin, an epoxy resin, a polyimide, a cyanate ester, a polycyanurate or other thermosets. In some instances, the housing or body can include both thermoplastic and thermoset materials.

In some embodiments, the housing of the holder can include a sleeve or reservoir of material to function as a heat sink. For example, one or more fluids or materials can be placed in a sleeve that can contact surfaces of the lip balm tube over an effective surface area to transfer heat from the lip balm tube to the holder. Heat transfer can facilitate retention of the lip balm within the tube in its desired form or consistency. If desired, one or more heatable or microwavable materials can be present that can function to heat the lip balm tube holder prior to placement in a vehicle. For example, during winter months, the lip balm may harden or otherwise become too solid to facilitate proper use. The lip balm tube holder can be heated, e.g., in an oven, in a microwave, using a hair dryer or heating gun, etc. to raise the temperature of the lip balm tube holder to permit transfer to the lip balm tube holder and decrease the overall viscosity of the lip balm in the lip balm tube. If desired, the lip balm tube holder can be cooled, e.g., in a refrigerator, freezer, ice bath, etc., prior to use to assist in maintaining the lip balm in a desired state.

Figure 2:
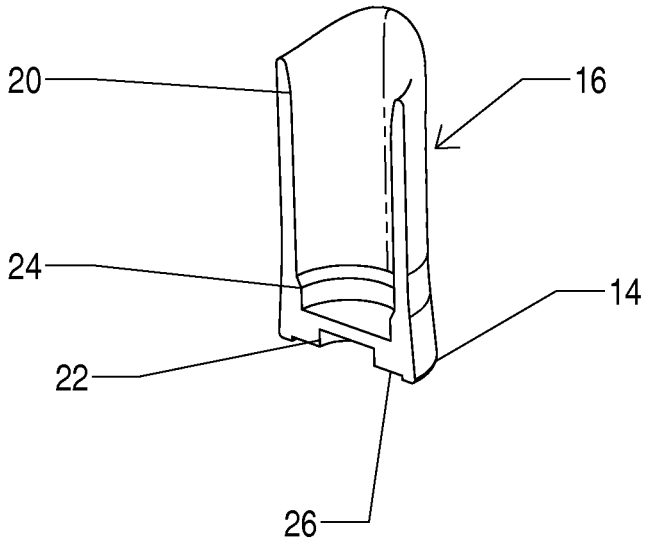
FIG. 2 is a sectional view of a lip balm holder, in accordance with certain examples.
Figure 11:
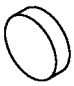
FIG. 11 is a perspective view of a magnet to be used in certain embodiments described herein, in accordance with certain examples.

Referring now to FIG. 2, a recess 22 can be created in the base of the holder 16 where a magnet FIG. 11 is affixed with adhesive or other means. It may be desirable to embed the magnet into the base of the holder such that the magnet does not inadvertently fall off or otherwise become removed during use. In some embodiments, the magnet may be held in a mold and the holder can be molded around the magnet to provide a desired shape with an embedded magnet in the base of the holder 16. The presence of holders with integral magnets provides desirable attributes including, but not limited to, an internal feature that permits retention of the holder in a desired place, prevents swallowing of magnets by small children or pets and other desirable features.

Figure 3:
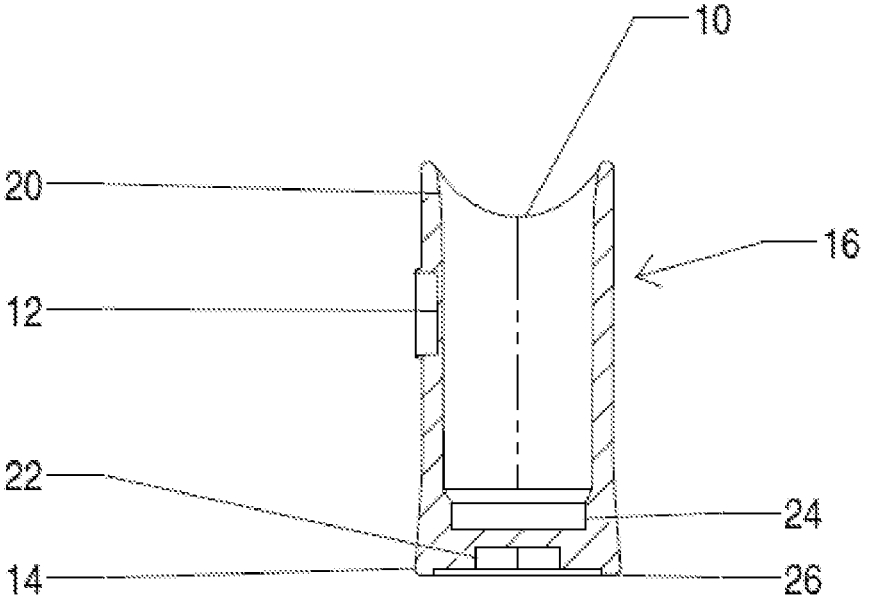
FIG. 3 is another sectional view of a lip balm holder, in accordance with certain examples.

Referring now to FIG. 3, with affixed magnet in recess 22 and 12 the holder 16 can be temporarily attached to any magnetic surface, keeping the lip balm holder 16 in a stable and upright position. The wider base 14, is designed as the second point of contact when attached to a vertical surface, preventing the holder 16, from rotating when attached to said vertical plane. The magnet is operative to retain the holder 16 in its upright position even when the holder 16 is subjected to gravitational forces or other forces which would cause the holder 16 to fall horizontally when the magnet was absent.

Figure 10:
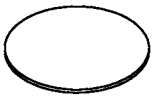
FIG. 10 is a perspective view of a steel disk to be used in conjunction with the lip balm holder, in accordance with certain examples.

In certain embodiments, where a magnetic surface is not available, a thin magnetic steel disc as shown in FIG. 10 may be provided with holder 16. The disc FIG. 10 can include an adhesive on one side to be applied to various surfaces. Referring to FIGS. 2 3, 4, 6, and 8, an additional recess 26 can be formed in the base of tube 16 which will fit over top of disk of FIG. 10 providing greater stability when holder 16 sits on horizontal surfaces.

Referring again to FIG. 3, the holder 16 is shown having a circumferential tapered edge 20 at the top portion of the cavity to allow for easier entry by tube 18 shown in FIG. 1. In certain instances, the internal diameter of the cavity of holder 16 can decrease in order to grip the base of tube 18 in FIG. 1 securely by a friction fit. This friction fit can assist in proper retention of the lip balm tube by the holder. If desired, the inside of the holder 16 can include bosses (not shown) at desirable spots to prevent over-insertion of the lip balm tube into the holder. When the base of the lip balm tube contacts the bosses, further insertion of the lip balm tube would not be possible.

Figure 4A:
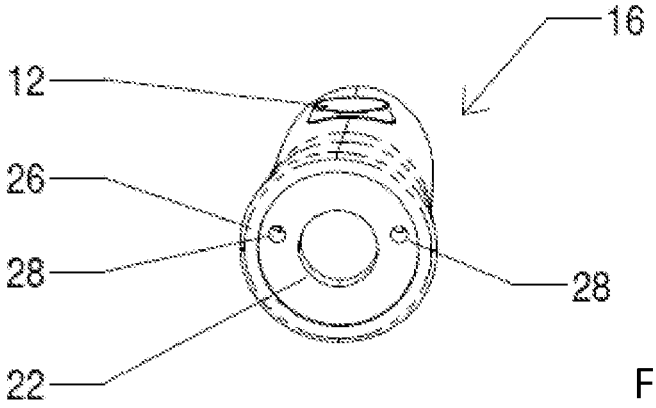
FIG. 4*a* is a bottom view of a lip balm holder.
Figure 4B:
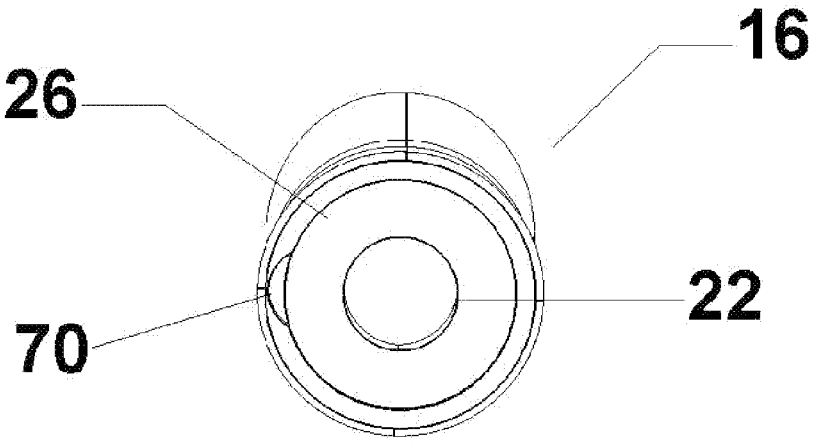
FIG. 4*b* is a bottom view of a lip balm holder showing a recess for a disk, in accordance with certain examples.

Referring now to FIG. 4*a*, one or more escapement holes or apertures 28 can be formed into the base of holder 16 to allow liquid to drain from cavity of holder 16. These holes can be configured with any cross-sectional shape and may alternatively be configured as slots. In some examples, the holes can include inserts to prevent fluid from entering the holder from the base of the holder. For draining, the inserts can be removed and fluid may be permitted to drain from the holder. Referring now to FIG. 4*b*, a depression 70 deeper than the recess 26 has been created in order to retrieve the disk if it becomes attracted unintentionally to magnet FIG. 11.

Figure 12:
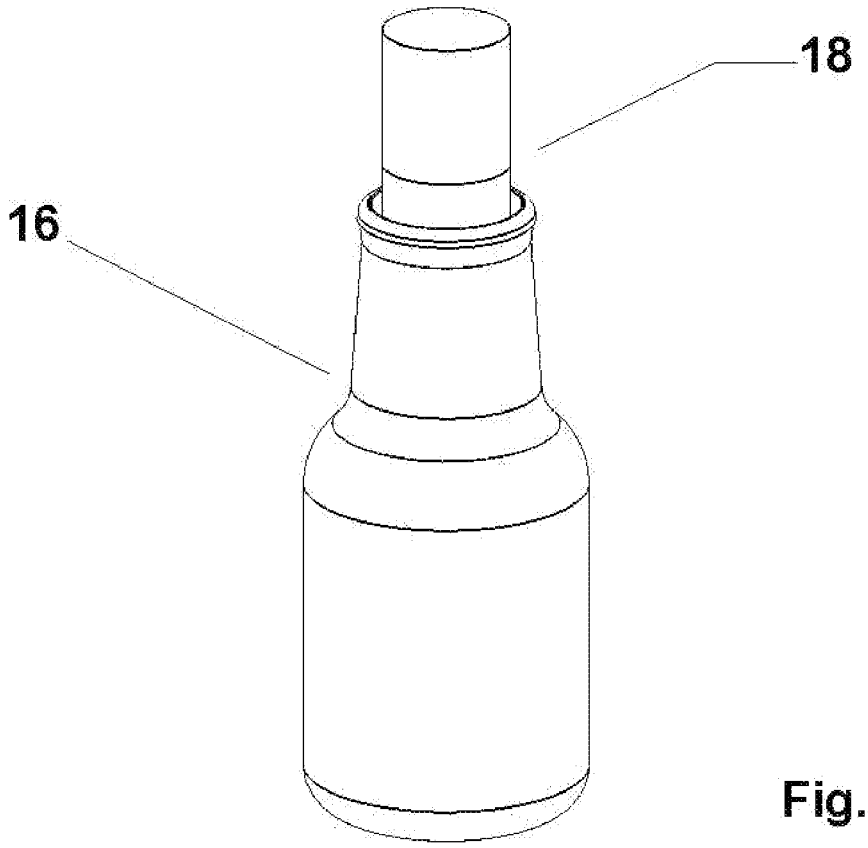
FIG. 12 is a perspective view of a lip balm tube holder configured as a bottle with a lip balm tube inserted, in accordance with certain examples.

In certain embodiments, the particular shape of the body of the holder may take various forms. While certain figures described herein show the body as comprising a generally cylindrical shape, other shapes are possible. For example, alternate shapes are envisioned such as a replica of a shotgun shell FIG. 5. & FIG. 6 as well as a miniature baseball bat FIG. 7 & FIG. 8. It is also possible that shapes with two or more cavities can be created to hold two or more tubes. In some instances, the shape may take the form of a bottle, e.g., beer bottle or soft drink bottle, as shown for example, in FIG. 12. If desired, a single base can be coupled to different types of second portions or components such that a user can select and couple a desired shape to the base to provide a desired shape to the holder assembly.

Figure 5:
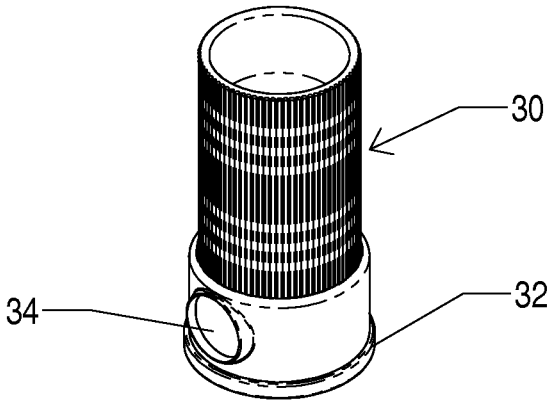
FIG. 5 is a perspective view of a modified form of a lip balm holder, in accordance with certain examples.
Figure 6:
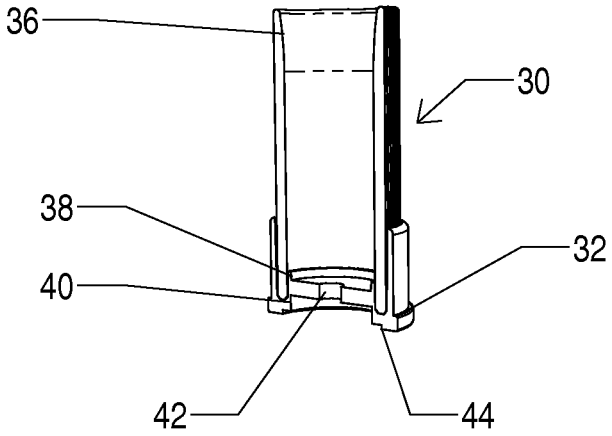
FIG. 6 is a sectional view of FIG. 5, in accordance with certain examples.

Referring now to FIG. 5, an alternative shape of the holder 30 is shown with a recess 34 near its base, where a magnet FIG. 11 can be affixed. In FIG. 5, the greater width of the base 32 compared to the rest of the holder 30 provides a first contact point, allowing for greater stability, when placed on vertical plane. Referring to FIG. 6, a circumferential tapered edge 36 is shown at the top of holder 30 allowing for less resistance when the lip balm tube (see, e.g., FIG. 1, element 18) is inserted. In certain examples, the tube will come in contact with a point with a decreased internal diameter 38 which will provide friction to grip the tube at its base. In some embodiments, a single escapement hole 42 for liquids is seen at the base of holder 30. If desired, a recess 40 can be created in the bottom of holder 30 to receive a magnet FIG. 11, allowing for the holder 30 to be attracted to a ferrous surface, or when necessary to the steel disk shown as FIG. 10. An additional recess 44 can be provided to fit over a ferrous steel disk, FIG. 10, providing additional stability to holder 30.

Figure 7:
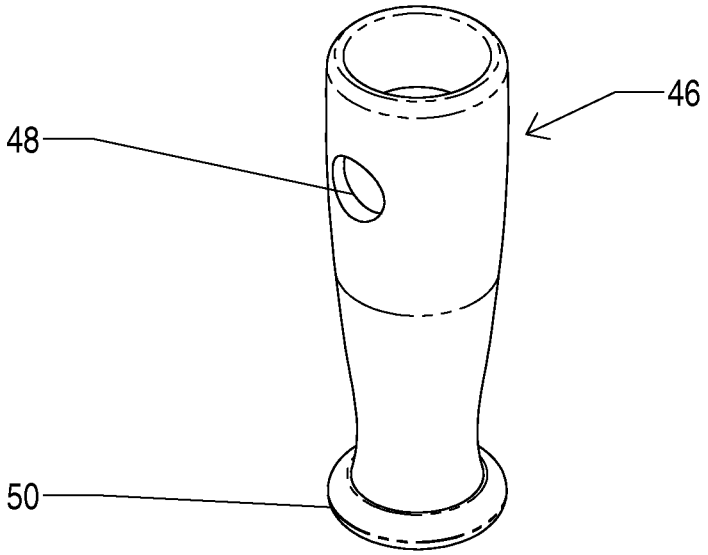
FIG. 7 is a perspective view of yet another embodiment of a lip balm holder, in accordance with certain examples.
Figure 8:
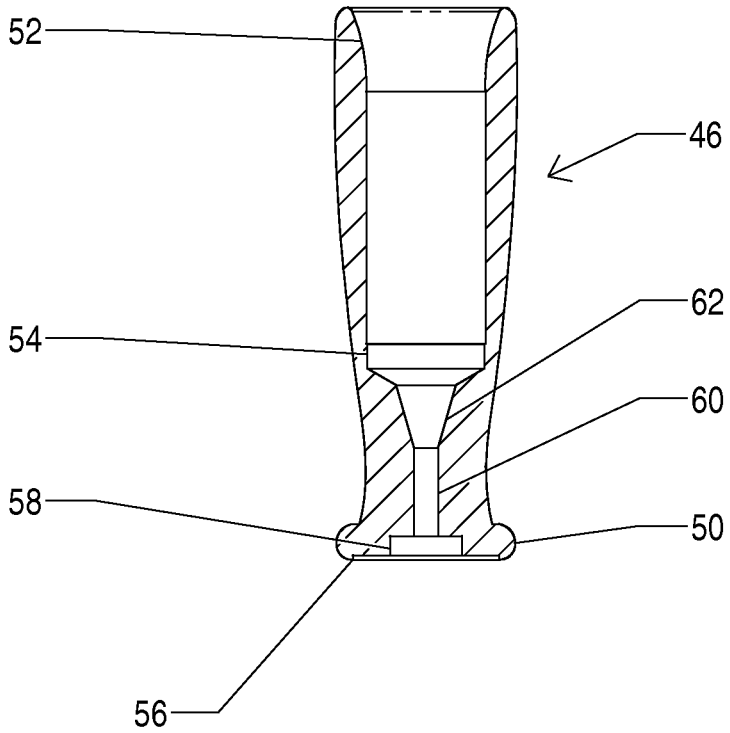
FIG. 8 is a sectional view of FIG. 7, in accordance with certain examples.

Another alternative shape for a holder is shown in FIG. 7 with a recess 48 along its length intended to receive a magnet FIG. 11. In certain embodiments, the holder 46 has a wide base 50 allowing for a first point of contact when affixed to a vertical planar surface. Referring now to FIG. 8, a tapered circumferential opening 52 is shown at the top of the entrance to the holder 46 and a decreased internal diameter 54 is shown at the internal base of holder 46. In certain embodiments, a singular escapement hole 60 for liquids is shown. In some examples, the base of the holder 46 reveals a recess 58 for a magnet, FIG. 11 and an additional recess 56 for a steel disk, FIG. 10.

Referring still to FIG. 8, the holder 46 comprises a cavity 62 within its base suitable for an ink pen tip, so that a pen can be placed in the holder 62 and be centered while standing vertically. In certain embodiments the holder can be made, e.g., sized and arranged, to retain items other than a lip balm tube, such as shirt collar stays, pens, pencils, and pen knives.

Figure 9:
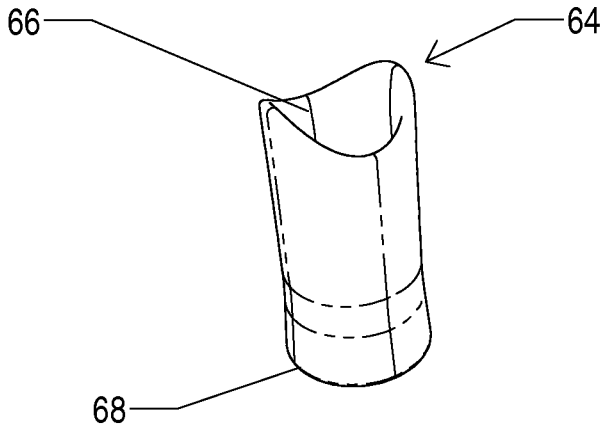
FIG. 9 is a modified form of the embodiment shown in FIG. 1, in accordance with certain examples.

In certain embodiments, a lip balm tube holder that lacks a recess may also be used to retain a lip balm tube. For example and referring to FIG. 9, the holder can be produced without a recess along its height 12 as found in FIGS. 1, 3, 4, 5, and 7.

Figure 13:
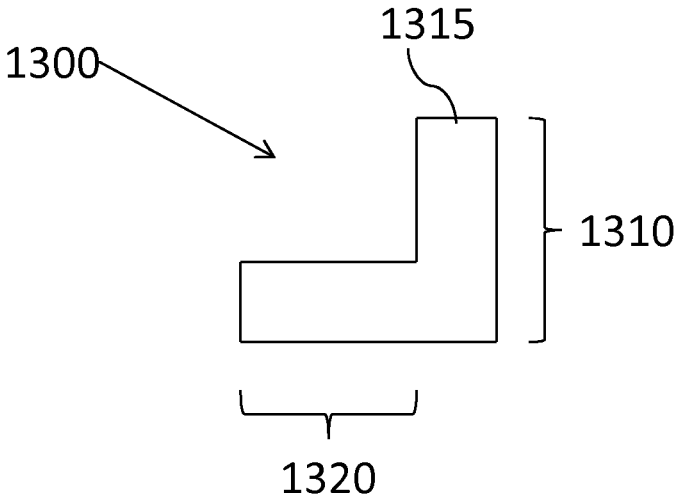
FIG. 13 is an illustration of a lip balm tube holder comprising coupling means and a first portion perpendicular to a second portion, in accordance with certain examples.

In some embodiments, the lip balm tube can include conducting means and/or coupling means to permit use of the lip balm tube holder with an electrical accessory outlet of a vehicle. Referring to FIGS. 13-16, several embodiments of a lip balm tube holder comprising conducting means is shown. In some embodiments, the coupling means may take the form of a conductive element that can couple to an electrical accessory outlet of a vehicle, e.g., a car. For example, the coupling means can include one or more conductive electrodes, strips or materials that can receive current from the electrical accessory outlet. Referring to FIG. 13, a lip balm tube holder 1300 comprises a first portion 1310 and a second portion 1320. The first portion 1310 is generally perpendicular to the second portion 1320. If desired, the first portion 1310 can be removed or decoupled from the second portion 1320 to provide two separate pieces and/or to permit different first portions to be coupled to the second portion. The first portion 1310 comprises an opening 1315 that can receive a lip balm tube and can generally retain the lip balm tube in an upright position. The second portion 1320 can include coupling means such as, for example, a conductive element, e.g., conductive strips of material similar to those commonly found on a vehicle charger for a cell phone. The conductive element can be electrically coupled to one or more other devices or components embedded in the housing. For example, the housing may include an active cooler or heater, e.g., a Peltier cooler or wire coil heater, to alter the temperature of the lip balm within the lip balm tube. In some embodiments, a thermostat or other temperature control device or temperature sensor can be present to provide a desired temperature within the lip balm tube holder. In additional embodiments, one or more light sources, e.g., light emitting diodes or other light sources, can be present in the housing to provide some illumination to the housing or within the housing, e.g., to light up the inside of the housing and facilitate insertion of the lip balm tube into the holder at night.

In other embodiments, the coupling means can be coupled to an electrical coupler. For example and referring to FIG. 14, a lip balm tube holder 1400 comprising a first portion 1410 and a perpendicular second portion 1420. The first portion comprises an opening 1415 that can receive a lip balm tube and generally retain the lip balm tube in an upright position. A coupling means in the second portion 1420 can be electrically coupled to an electrical coupler 1430, which can take the form of a USB connector, mini-USB connector, micro-USB connector, a 30-pin or 10-pin connector commonly found in devices for charging iPhone® and iPod® devices or other electrical connectors that can provide power to one or more external devices such as a phone, GPS, tablet or other electrical devices.

Figure 14:
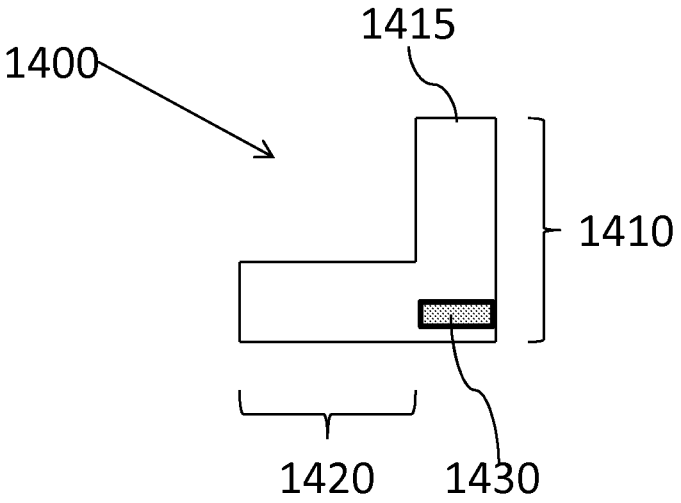
FIG. 14 is an illustration of a lip balm tube holder comprising coupling means, an electrical coupler, and a first portion perpendicular to a second portion, in accordance with certain examples.
Figure 15:
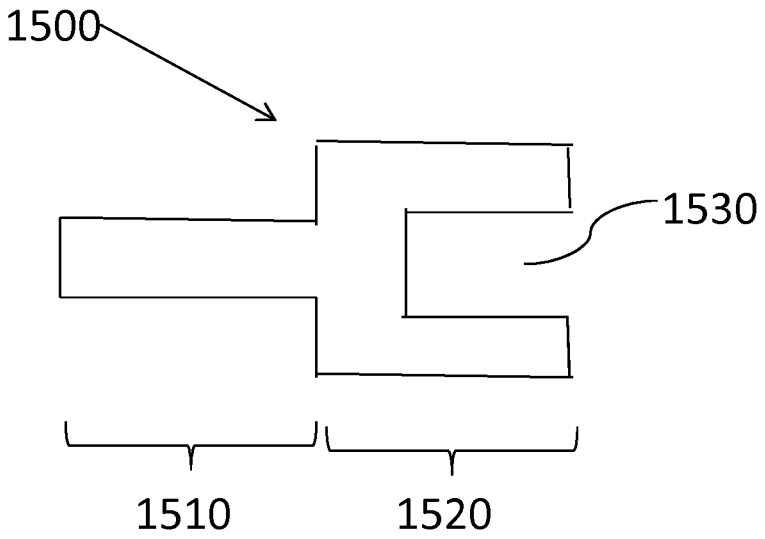
FIG. 15 is an illustration of a lip balm tube holder comprising coupling means and a first portion substantially parallel to a second portion, in accordance with certain examples.
Figure 16:
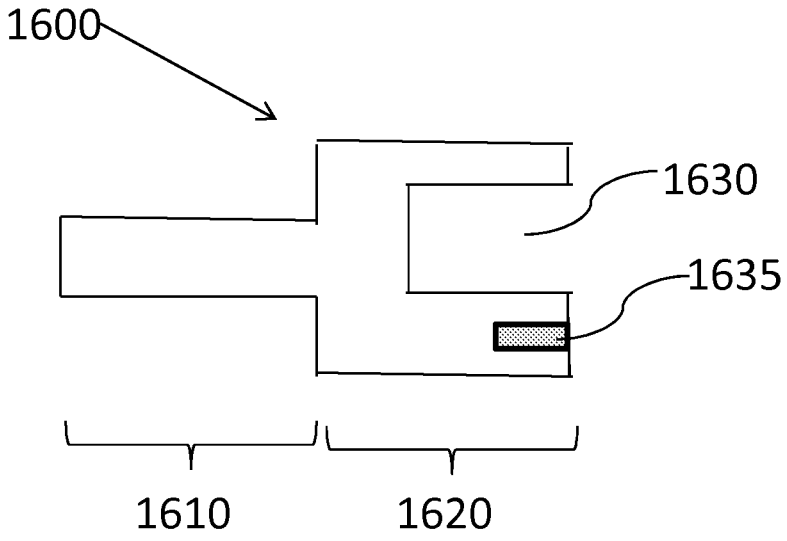
FIG. 16 is an illustration of a lip balm tube holder comprising coupling means, an electrical coupler, and a first portion substantially parallel to a second portion, in accordance with certain examples.

While the lip balm tube holders shown in FIGS. 13-14 comprises a perpendicular portion that can retain a lip balm tube, the various sections or portions of the lip balm tube holder need not be perpendicular. Referring to FIG. 15, a lip balm tube holder 1500 is shown that comprises a first portion 1510 coupled to a second portion 1520 that is generally parallel to the first portion 1510. The first portion 1510 comprises coupling means configured to receive an electrical current from a vehicle. The second portion 1520 comprises an opening 1530 configured to receive a lip balm tube as described herein. Referring to FIG. 16, a lip balm tube holder 1600 comprising a first portion 1610 and a second portion 1620 that is generally parallel to the first portion 1610. The second portion 1620 comprises an opening 1630 for receiving a lip balm tube holder. The second portion 1620 also comprises an electrical coupler 1635 which can take the form of a USB connector, mini-USB connector, micro-USB connector, a 30-pin or 10-pin connector commonly found in devices for charging iPhone® and iPod® devices or other electrical connectors that can provide power to one or more external devices such as a phone, GPS, tablet or other electrical devices. As described in reference to FIG. 13, the holders shown in FIGS. 14-16 can include a cooling element, a heating element, a thermostat, a light source or other desired features. If desired, the electrical couplers 1430 and 1635 can be positioned within the opening of the lip balm tube holder such that insertion of the lip balm tube renders the coupler inaccessible. To access the electrical coupler, the user would remove the lip balm tube from the holder and then plug in a suitable wire or cable to the electrical coupler.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

The invention claimed is:

1. A lip balm tube holder comprising:

a tubular body comprising an opening and an interior surface sized and arranged to releasably receive a single lip balm tube and retain the lip balm tube through a friction fit, the body comprising a closed base configured to be adjacent to a base of the lip balm tube when the lip balm tube is positioned in the body, in which the closed base comprises a recess;

attachment means coupled to the closed base of body through the recess of the closed base, the attachment means configured to retain the body of the lip balm tube holder vertically when exposed to a force; and a lip balm tube comprising a dispensing mechanism at a base end and a cap at the opposite end, in which the balm tube is positioned in the opening of the body and retained by the body through the friction fit, in which the lip balm tube is held vertically by the body to place a long axis of the lip balm tube parallel to a a long axis of the tubular body when the lip balm tube is positioned in the opening of the body, in which the lip balm tube comprises lip balm, and wherein the lip balm tube extends out of the opening when secured in the body and is separable from the body in order to enable the user to dispense the lip balm from the lip balm tube.

2. The lip balm tube holder of claim 1, in which the attachment means comprises magnet means.

3. The lip balm tube holder of claim 1, in which the body is configured as a tapered body with a diameter of the body at a mouth of the opening larger than a diameter at the closed base of the body.

4. The lip balm tube holder of claim 1, in which the body is configured to comprise a shotgun shell shape.

5. The lip balm tube holder of claim 1, in which the body is configured to comprise a baseball bat shape.

6. The lip balm tube holder of claim 1, further comprising at least one logo or other indicia on an outer surface of the lip balm tube holder.

7. A lip balm tube holder comprising:

a tubular body comprising an opening and an interior surface sized and arranged to releasably receive a lip balm tube and retain the lip balm tube through a friction fit, the body comprising a closed base configured to be adjacent to a base of the lip balm tube when the lip balm tube is positioned in the body, the closed base comprising a recess;

attachment means coupled to the closed base of the body through the recess of the closed body, the attachment means configured to keep the tubular body stationary on a horizontal surface; and a lip balm tube comprising a dispensing mechanism at a base end and a cap at the opposite end, in which the balm tube is positioned in the opening of the body and retained by the body through the friction fit, in which the lip balm tube is held vertically by the body to place a long axis of the lip balm tube parallel to a a long axis of the tubular body when the lip balm tube is positioned in the opening of the body, in which the lip balm tube comprises lip balm, and wherein the lip balm tube extends out of the opening when secured in the body and is separable from the body in order to enable the user to dispense the lip balm from the lip balm tube.

8. The lip balm tube holder of claim 7, in which the attachment means comprises magnet means positioned on a longitudinal surface of the body.

9. The lip balm tube holder of claim 7, in which the body is configured as a tapered body with the diameter of the body at a mouth of the opening larger than a diameter of the body at the base.

10. The lip balm tube holder of claim 7, in which the body is configured to comprise a shotgun shell shape.

11. The lip balm tube holder of claim 7, in which the body is configured to comprise a bat shape.

12. A lip balm tube holder comprising:

a tubular body comprising a housing comprising a closed base and an opening comprising an interior surface sized and arranged to releasably receive a separate lip balm tube and retain the separate lip balm tube through a friction fit, the closed base configured to be adjacent to a base of the lip balm tube when the lip balm tube is positioned in the body, the closed base comprising a recess;

attachment means coupled to the closed base of the housing through the recess of the closed base, the attachment means configured to retain the lip balm tube holder vertically when exposed to a force; and a lip balm tube comprising a dispensing mechanism at a base end and a cap at the opposite end, in which the balm tube is positioned in the opening of the body and retained by the body through the friction fit, in which the lip balm tube is held vertically by the body to place a long axis of the lip balm tube parallel to a vertical surface coupled to the attachment means, in which the lip balm tube comprises lip balm, and wherein the lip balm tube extends out of the opening when secured in the body and is separable from the body in order to enable the user to dispense the lip balm from the lip balm tube.

13. The lip balm tube holder of claim 12, in which the attachment means comprises magnet means.

14. The lip balm tube holder of claim 12, in which the body is configured as a tapered body with a diameter of the body at a mouth of the opening larger than a diameter at a base of the body.

15. The lip balm tube holder of claim 12, in which the body is configured to comprise a shotgun shell shape.

16. The lip balm tube holder of claim 12, in which the body is configured to comprise a baseball bat shape.

* * * * *